US008820402B2

(12) United States Patent
Smith, II et al.

(10) Patent No.: US 8,820,402 B2
(45) Date of Patent: Sep. 2, 2014

(54) DOWNHOLE SHOCK ABSORBER WITH GUIDED CRUSHABLE NOSE

(75) Inventors: Troy L. Smith, II, Tulsa, OK (US); Anthony S. Coghill, Tulsa, OK (US); Thomas S. Myerley, Broken Arrow, OK (US); Douglas A. G. Lowery, Broken Arrow, OK (US); James T. Sloan, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 335 days.

(21) Appl. No.: 13/346,446

(22) Filed: Jan. 9, 2012

(65) Prior Publication Data

US 2013/0175028 A1 Jul. 11, 2013

(51) Int. Cl.
*E21B 17/07* (2006.01)

(52) U.S. Cl.
USPC ..... 166/169; 166/242.7; 188/371

(58) Field of Classification Search
CPC ..... E21B 17/07; F16F 7/00; F16F 7/125; F16F 7/126; F16F 9/00; F16F 13/00
USPC ..... 166/242.7, 381, 169, 178; 188/371, 188/377, 376, 375, 372; 267/125
See application file for complete search history.

(56) References Cited

U.S. PATENT DOCUMENTS 2,323,321 A * 7/1943 Futral ..... 267/125
2,577,599 A * 12/1951 Bethancourt ..... 73/152.01
2,812,717 A * 11/1957 Brown ..... 166/243
3,032,302 A 5/1962 Clark
3,096,268 A * 7/1963 Eades et al. ..... 188/375
3,182,449 A * 5/1965 Kerney et al. ..... 137/70
3,653,468 A 4/1972 Marshall
3,949,150 A 4/1976 Mason et al.
4,035,011 A * 7/1977 Gazda et al. ..... 294/86.18
4,171,025 A * 10/1979 Bassinger ..... 175/65
4,413,516 A * 11/1983 Croom et al. ..... 73/431
4,427,061 A * 1/1984 Moore ..... 166/113
4,679,669 A 7/1987 Kalb et al.
4,693,317 A 9/1987 Edwards et al.
4,779,852 A * 10/1988 Wassell ..... 267/125
4,817,710 A 4/1989 Edwards et al.
4,932,471 A 6/1990 Tucker et al.
4,997,037 A * 3/1991 Coston ..... 166/105
5,183,113 A 2/1993 Leaney et al.
5,509,475 A * 4/1996 Lewis ..... 166/68
5,875,875 A 3/1999 Knotts
6,109,355 A 8/2000 Reid
6,454,012 B1 9/2002 Reid
6,708,761 B2 3/2004 George et al.

(Continued)

*Primary Examiner* — Jennifer H Gay
(74) *Attorney, Agent, or Firm* — Steve Rosenblatt

(57) ABSTRACT

A shock absorbing system has a nose assembly that is formed to inwardly collapse on impact and is guided by a sleeve that can slide with the nose as the nose collapses or can extend for a portion of the length of the nose while being held fixed. In the latter instance the nose can have a leading end that has a biasing member in a resilient material so that on impact some of the shock is taken up by compression of the biasing member with subsequent extension of the biasing member retracting the resilient covering so that it is less likely to bind in the surrounding tubular. The leading end of the sleeve or the resilient material encasing the biasing member also soften the blow to a closed ball when the tool is dropped so that the ball surface is less likely to mar.

34 Claims, 3 Drawing Sheets

(56) References Cited

U.S. PATENT DOCUMENTS

| | | | | |
|---|---|---|---|---|
| 7,314,080 | B2 * | 1/2008 | Giacomino | 166/105 |
| 7,779,907 | B2 | 8/2010 | Wagner et al. | |
| 2003/0089497 | A1 * | 5/2003 | George et al. | 166/297 |
| 2004/0140090 | A1 * | 7/2004 | Mason et al. | 166/242.1 |
| 2006/0124292 | A1 * | 6/2006 | Victor | 166/68 |
| 2009/0242190 | A1 * | 10/2009 | Wagner et al. | 166/156 |
| 2013/0175028 | A1 * | 7/2013 | Smith et al. | 166/242.7 |

* cited by examiner

DOWNHOLE SHOCK ABSORBER WITH GUIDED CRUSHABLE NOSE

FIELD OF THE INVENTION

The field of the invention is shock absorbers that can lessen damage to downhole components if a tool string is accidentally released and more particularly a guided crushable nose on a shock absorber to enhance its performance where the guide directs the collapse of the nose internally to enhance the ability of removal of the nose after it is crushed.

BACKGROUND OF THE INVENTION

Shock absorbers are used in downhole applications to protect equipment in the well if a tool string is accidentally released. The kinetic energy of the falling string or other object is dissipated by a shock absorber to reduce or eliminate damage from impact.

In some designs for downhole shock absorbers, relative movement crushes material in the absorber or radially deforms one member as another with an interference fit is forced into it or simply uses a sharpened tungsten carbide element to rip into a telescoping tube. These designs and variations of them are illustrated in U.S. Pat. Nos. 6,454,012; 6,109,355; 6,708,761; 3,653,468; 3,949,150; 4,679,669; 4,693,317; 4,817,710; 3,032,302 and 4,932,471. U.S. Pat. No. 5,875,875 relates generally to shock absorbers in unrelated industrial applications such as vehicles, machinery and buildings. It stays away from using liquids and gasses claiming that the cost of precision machining and seals that pneumatic or hydraulic designs entail makes them cost more to fabricate and maintain. Instead it focuses on foams and other materials that can stay in a cavity without seals until the absorber is actuated.

Yet another design for downhole use forces a plunger into a housing and creates an exit flow path to a port for the mud in the housing as the piston top gets further away from the ports. In this manner the resistance to piston movement progressively increases the greater the relative movement between the piston and its surrounding housing. This design is described in U.S. Pat. No. 5,183,113.

It is also worth noting that the design in U.S. Pat. No. 6,109,355 features a leading end 18 made of brass so that it can take the initial impact and dissipate it. The nose 18 features a flow path into the tool string.

The shock absorber in U.S. Pat. No. 7,779,907 provides a shock absorber that uses well fluids. It is held in the run in position until it receives an impact that creates relative movement. As a result the volume of a fluid chamber preferably filled with incompressible fluid and temporarily retained by a breakable member is reduced as the fluid is forced through an orifice and into the surrounding wellbore. The initial impact is absorbed by a nose intended to be crushed using voids designed to allow it to collapse on itself on impact.

In U.S. Pat. No. 7,779,907 a downhole shock absorber preferably is filled with well fluid in a chamber that is reduced in volume due to impact. A rupture disc can hold the initial non-compressible liquid charge until impact. Upon impact, the rupture disc breaks to allow the fluid to be forced through an orifice to absorb some of the shock that occurs when a string hits a fixed object after dropping in the wellbore. The nose of the shock absorber is a soft material that has voids so that the combination of the softness of the material and the voids allow the nose to reshape until it encounters a surrounding tubular wall and then to collapse inwardly into the voids, making it simple to remove. The nose is releasably mounted to the shock absorber so the two can separate if the nose gets stuck after impact.

Referring to FIG. 1 of U.S. Pat. No. 7,779,907 the tubing string (not shown) is connected to the top of top sub 3. The shock absorber assembly 1 further comprises a housing 7 secured to top sub 3 with a carrier 8 used to sandwich a rupture disc 12 and a retaining ring 11 against the top sub 3. Seals 13 and 14 prevent fluid bypass around the rupture disc 12. Lower sub 2 is connected to housing 7 and the connection is sealed at seal 14. Carrier 8 has an orifice 20 that leads into chamber 22 where the rupture disc 12 is mounted. A series of outlets 24 communicate into the surrounding wellbore.

A piston assembly 26 has an upper body 15 secured to a lower body 4 with set screws 16 and utilizing a seal 17 sealing the connection. Nose retainer 6 is secured to lower body 4 with another seal 16 sealing the connection. A shear pin 28 holds nose 30 to the retainer 6. Upper body 15 has a longitudinal bore 32 that leads from upper cavity 52 to lower chamber 34. Lower chamber 34 can be used to drain upper cavity 52 by unscrewing lower body 4 after the tool is removed from a well. A shear pin 10 holds upper body 15 to lower sub 2 for run in. A seal 9 on upper body 15 initially rides on interior bore 38 of lower sub 2. A bushing 5, on upper body 15, rides on inside diameter 40 of the housing 7.

Referring to FIGS. 2-4 of U.S. Pat. No. 7,779,907 the nose 30 has a longitudinal bore 42 that crosses transverse bores 44 and 46. The purpose of the bores is to remove material so that when nose 30 gets the initial impact its tendency will be to grow radially to meet the surrounding tubular wall and thereafter it can cave in on itself as it is crushed into the passages 42, 44 and 46. This ability to crush inwardly enhances the prospect that when the string (not shown) is pulled out that the nose 30 will not stick in the surrounding tubular. Even if nose 30 sticks after it is crushed, the shear pin 28 in bore 48 can break and the assembly 1 up to and including nose retainer 6 can come out.

It should be noted that inside diameter 38 is smaller than inside diameter 40 and that a shoulder 50 is formed on lower sub 2 to retain the upper body 15 when the string (not shown) that is connected to sub 3 is removed after it has dropped. Because of the difference in dimension between diameters 38 and 40 when there is relative movement between the upper body 15 and the surrounding housing 7 a chamber of increasing volume opens between them. To avoid pulling a vacuum in this chamber that has to grow in volume to allow the piston assembly 26 to move toward orifice 20 bore 32 and passage 36 allow fluid to rush into this growing cavity to avoid pulling a vacuum in it so that the motion of the piston assembly 26 can continue without a resisting force from that enlarging chamber.

In operation when the string (not shown) is dropped, the nose 30 which is preferably made from a soft metal, elastomer, plastic, encased gel or combinations of the above, absorbs the initial impact and crushes longitudinally until it hits the surrounding tubular wall at which point it crushes back inwardly against its various bores. Those skilled in the art will appreciate that the nose needs sufficient structural rigidity to absorb the impact of the encounter with a well obstruction upon impact. However the bores allow further impact absorption by providing an internal void into which the structure of the nose 30 can be crushed to further aid in reducing the severity of the blow against the object in the well that has broken the fall of the string (not shown). Optionally the voids defined by these passages can be filled with a gel or viscous grease for greater absorption of impact followed by expelling the material and the internal collapse of the nose into its voids. As a result the prevailing mode of failure is longitudinal crushing and the risk of getting the nose 30 stuck against the inside wall of the surrounding tubular, making removal more difficult, is diminished. In any event the shock absorber 1 can be pulled up and shear pin 28 can shear leaving the nose in place for subsequent mill out. An upward pull on housing 7 will bring with it the piston assembly 15 due to shoulder 50 retaining the piston assembly 15.

The impact force of the landing of nose 30 will also stop the piston assembly 15 from moving further as the housing 7 continues to move down. This raises the pressure in chamber 52 causing pressure buildup that will break the rupture disc 12. Well fluid that initially filled chamber 52 up to the rupture disc 12 will now be driven through the orifice 20 and into the wellbore through passages 24. It should be noted that it is preferred to pre-fill the chamber 52 with fluid and assemble the rupture disc 12 to initially retain such fluid. The reason is that some wells can have a gas filled upper layer and if the rupture disc was not there the chamber 52 could initially be gas filled. If the string was dropped with the chamber 52 still gas filled there may not be enough time before impact for the chamber 52 to fill with liquid to properly operate and avoid impact damage. In the preferred embodiment a non-compressible fluid filled chamber 52 is maintained with a closure that is removable such as rupture disc 12. Upon reduction of volume of chamber 52 the orifice 20 provides a constant resistance to movement of the housing 7 to further dissipate the shock of impact all before the lower sub 2 reaches a travel limit.

What has been described in U.S. Pat. No. 7,779,907 is a shock absorber with a crushable nose. The nose is configured of a soft material and includes voids to enhance the prospect of longitudinal crushing on impact and to facilitate the removal of the nose after impact. An emergency release from the nose 30 is provided. The number, size and orientation of the voids can be varied as well as the material selection to achieve the desired impact absorption strength. The shock absorber provides a constant resistance to collapse on impact and the removable barrier assured that the preferred non-compressible fluid is fully charged into cavity 52 so that it is there when needed even if the assembly 1 is dropped when it is still in a gas pocket in the well. It should be noted that the rupture disc 12 need not be built to resist the hydrostatic pressure at the final depth for the location of the absorber 1. Rather, the purpose of the rupture disc is simply to retain fluid in chamber 52 long enough to get the shock absorber into a portion of the well that is liquid filled. For that same reason, the components of the absorber 1 do not need to be made thick so as to withstand large differentials because simply running in the absorber 1 can break the disc 12 at shallow depths causing the assembly to be in pressure balance to well fluids. While a rupture disc is preferred, other removable barriers are contemplated that can go away by a variety of techniques such as dissolving, melting or chemically reacting, to mention a few.

The housing 7 with lower sub 2 can literally be pulled apart from a stuck piston assembly 26 after a drop. In the event that assembly 1 becomes separated from the tool string, a fishing tool can then come in on another trip to grab a fishing neck just above the bushing 5 to remove the balance of the tool. Also, should the piston assembly 26 become separated from the lower sub 2 a fishing tool can be used to grab a fishing neck just above the upper body 15.

The housing 7 does not need the pressure rating of the string (not shown) that is disposed above it. The rupture disc 12 is set low enough that minimal relative movement will break it. The orifice 20 is sized to prevent pressure buildup in housing 7 that could deform it plastically and for all intents and purposes the fluid flow through the orifice 20 is low enough so that the wall that defines housing 7 doesn't even flex. One reason for this is that the crushable nose 30 dissipates the brunt of the kinetic energy on impact.

The present invention provides an improvement to the nose 30 that presents a sleeve to confine the nose as it is impacted after a drop to prevent radial deformation that could stick the nose to the surrounding tubular and make removal of the nose with the string more difficult to accomplish. The sleeve moves in tandem with the nose as the nose is crushed. The sleeve can totally or partially initially cover the nose. The leading end of the nose can also have a biasing element covered in a resilient material to take some of the shock loading by compressing and then by lengthening after impact draw in the resilient covering so as to reduce the chance of sticking the nose assembly. These and other features of the present invention will be more apparent to those skilled in the art from a review of the description of the preferred embodiment and the associated drawings that appear below while recognizing that the claims define the full scope of the invention.

SUMMARY OF THE INVENTION

A shock absorbing system has a nose assembly that is formed to inwardly collapse on impact and is guided by a sleeve that can slide with the nose as the nose collapses or can extend for a portion of the length of the nose while being held fixed. In the latter instance the nose can have a leading end that has a biasing member in a resilient material so that on impact some of the shock is taken up by compression of the biasing member with subsequent extension of the biasing member retracting the resilient covering so that it is less likely to bind in the surrounding tubular. The leading end of the sleeve or the resilient material encasing the biasing member also soften the blow to a closed ball when the tool is dropped so that the ball surface is less likely to mar.

DETAILED DESCRIPTION OF THE PREFERRED EMBODIMENT

Figure 1:
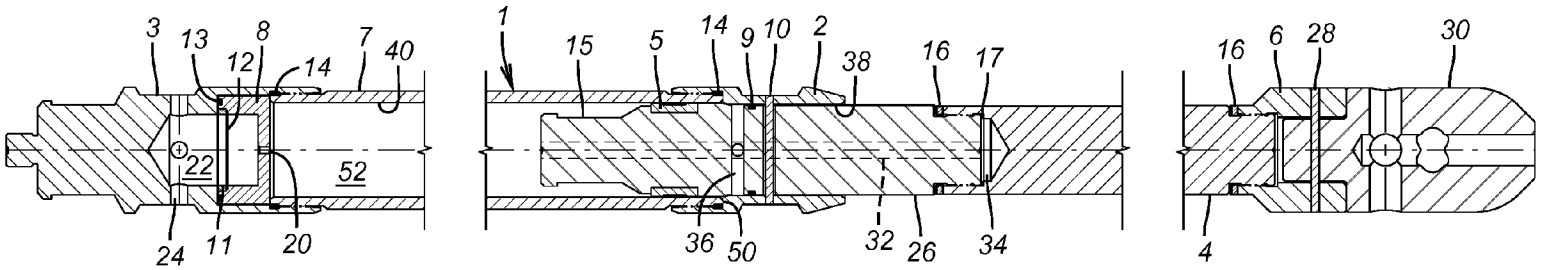
(PRIOR ART) FIG. 1
FIG. 1 is a section view of the prior art shock absorber in the run in position as originally depicted in U.S. Pat. No. 7,779,907.
Figure 2:
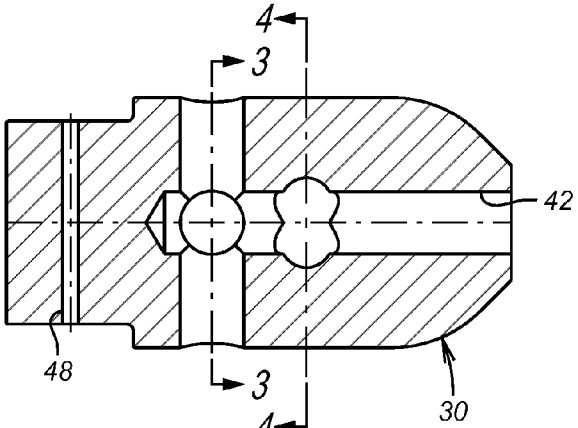
(PRIOR ART) FIG. 2
FIG. 2 is a detailed section view of the nose of the shock absorber shown in FIG. 1.
Figure 3:
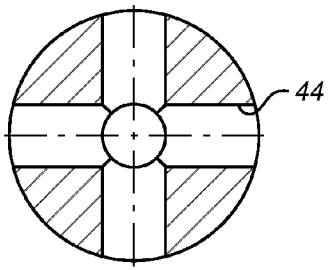
(PRIOR ART) FIG. 3
FIG. 3 is the view along line 3-3 of FIG. 2.
Figure 4:
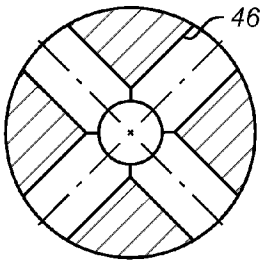
(PRIOR ART) FIG. 4
FIG. 4 is the view along line 4-4 of FIG. 2.
Figure 5:
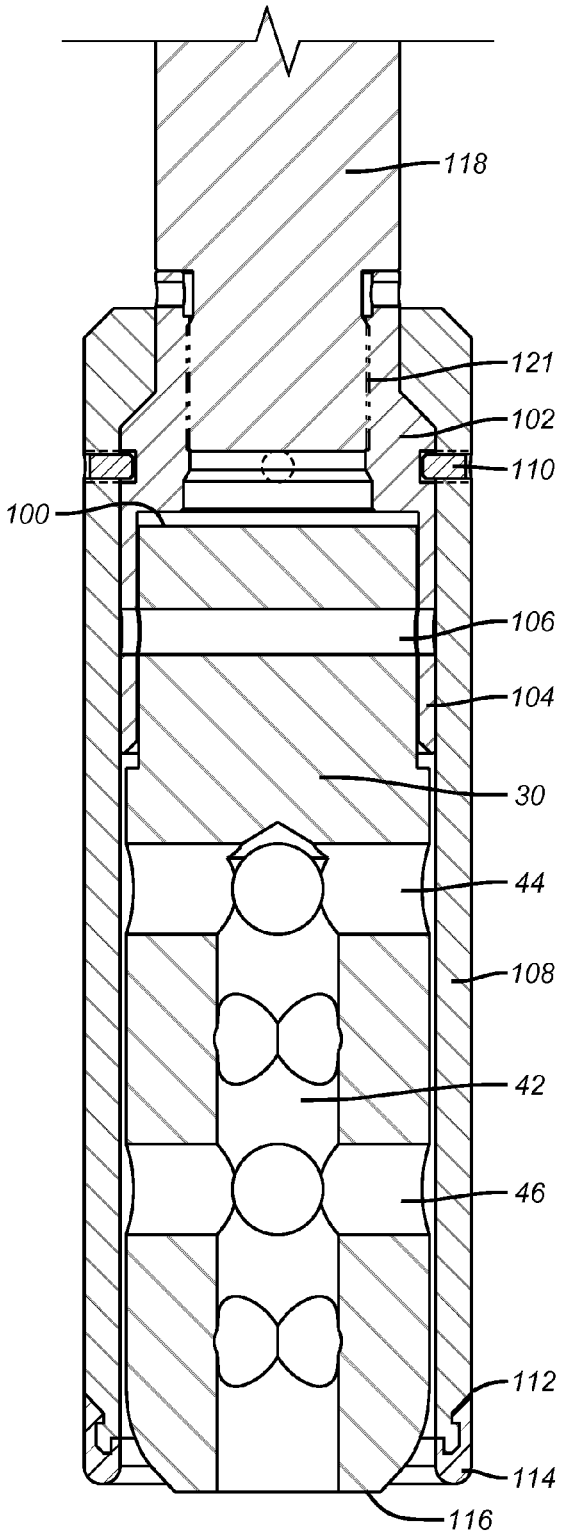
FIG. 5 is a section view of the present invention showing the movable sleeve in the initial position before impact.

Referring to FIG. 5 the nose 30 is the same as shown in FIG. 1 except that at the upper end 100 the nose 30 is surrounded by an inner sleeve 102 that has a lower end annular component 104 that surrounds the upper end 100 of the nose 30. The nose 30 is retained to inner sleeve 102 by a rod that is not shown that extends in aligned passages 106 that extend into both the nose 30 and the inner sleeve 102. This is the preferred way of attaching these two components as the nose 30 is generally built of a soft material and threading the nose 30 can be difficult. An outer sleeve 108 is pinned at shear pin or pins 110 to the inner sleeve 102. The lower end 112 supports a resilient ring 114 that makes impact with for example a closed ball of a valve when a tool or a string that is not shown is dropped in the hole. Lower end 116 of the nose can extend further than, or equally to or less than the resilient ring 114. As an impact occurs, the resilient ring hits a fixed object as the nose 30 also engages the fixed object such as a closed ball valve. As previously described, the nose 30 collapses inwardly due to the presence of axial passage 42 and transverse passages 44 and 46, as shown in FIGS. 2-4. Axial compression of the nose 30 causes the shear pins or equivalent retainer 110 to break so that the outer sleeve 108 that overlaps inner sleeve 104 and the nose 30 moves up with nose 30 as the nose 30 is crushed and prevents radial enlargement of the nose 30 while promoting internal collapse toward axial passage 42 and transverse passages 44 and 46. If for any reason the outer sleeve 108 radially enlarges to the point of getting stuck a pull on the support member 118 that is attached to a tubular string that is not shown will cause a separation at thread 121 so that the string can be removed and the nose 30 with the outer sleeve 108 and the inner sleeve 102 can be later milled out.

Figure 6:
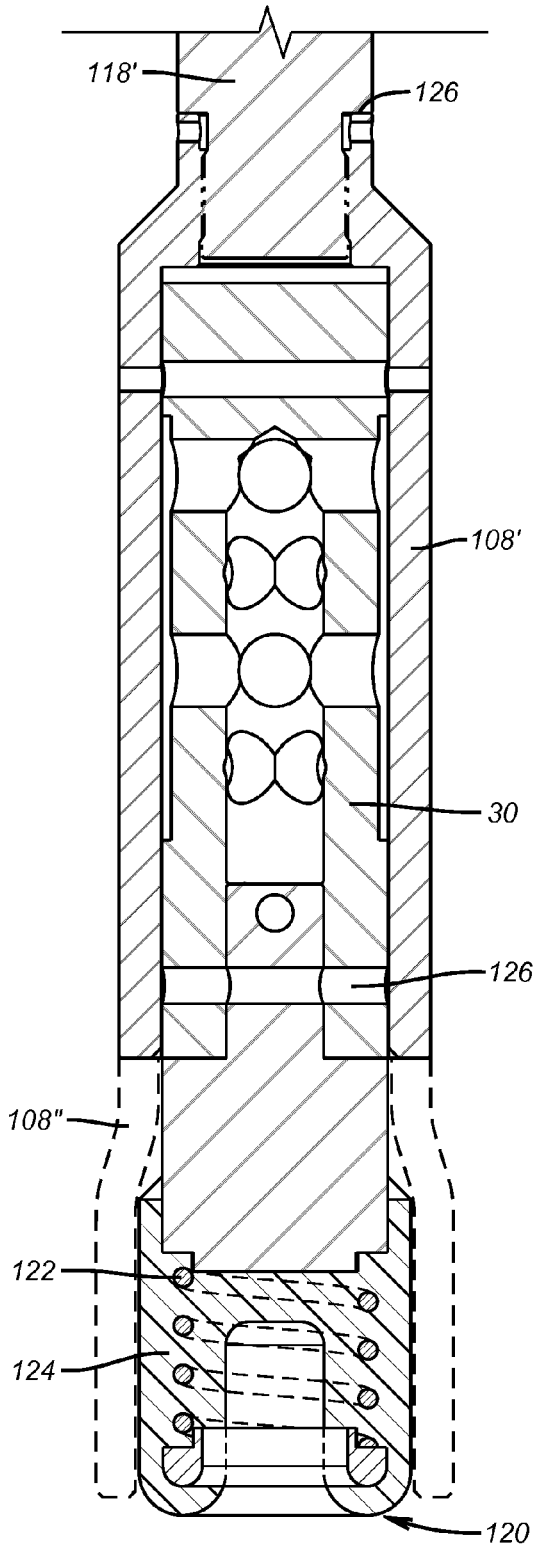
FIG. 6 shows two alternative designs in section where a leading end has an embedded biasing member that can either extend beyond a stationary sleeve or can have a movable sleeve that initially covers the leading end.

FIG. 6 shows an alternative design where the sleeve 108' can be shorter than the nose 30 including the lower end assembly 120 that further comprises a biasing member 122 that can be a coiled spring or a stack of Belleville washers or another flexible structure that can absorb impact that is at least in part or wholly covered by a resilient material 124. In the embodiment drawn, the sleeve 108' shoulders at 126 against the support 118'. In this embodiment the sleeve extension 108" is not used. On impact with the resilient material 124 against a fixed object such as a closed ball valve that is not shown some of the kinetic energy is absorbed in compressing the biasing member 122. There is some radial deformation of the resilient material 124 but such deformation is elastic and after impact as the biasing member 122 extends the resilient material and is retracted by the extension to reduce the risk of getting the resilient material 124 stuck. Even if the resilient material sticks, a strong enough applied force to the support 118' should get the resilient material to release even if it takes ripping the resilient material 124 into pieces. In the embodiment drawn in FIG. 6 without the extension 108", the collapse of the nose 30 still occurs in the manner of FIG. 5 except that the sleeve 108 does not move axially as the nose 30 collapses inwardly while sleeve 108' prevents radial growth of nose 30 because of the surrounding confinement that sleeve 108' provides.

In an alternative to what is drawn in FIG. 6 the extension 108" can be used and the sleeve 108' with the extension 108" can be releasably mounted to the support 118' so that impact will at some point move the lower end 120 with the sleeve 108' with its extension 108". In this alternative the lower end 120 is also radially confined by the extension 108" while the balance of the sleeve 108' still radially confines the nose 30 as nose 30 longitudinally collapses and the sleeve 108' and its extension move up to compensate for the axial shrinkage of the nose 30. Passage 126 is used to secure the lower end assembly 120 to the nose 30 with a pin that is not shown.

The above description is illustrative of the preferred embodiment and many modifications may be made by those skilled in the art without departing from the invention whose scope is to be determined from the literal and equivalent scope of the claims below.

We claim:

1. A shock absorber system for a tubular string supporting a tool in subterranean use, comprising;

a nose on a lower end of the string, said nose comprising at least one void to promote crushing said nose in a longitudinal direction on impact with a fixed object downhole;

a surrounding sleeve around said nose to resist radial dimensional growth of said nose during said crushing in a longitudinal direction;

said sleeve initially loosely surrounding said nose to allow said crushing in said longitudinal direction to create contact therebetween for said resistance to radial dimensional growth of said nose.

2. The system of claim 1, wherein:

said surrounding sleeve is fixed with respect to the string during said crushing of said nose.

3. The system of claim 2, further comprising:

a lower end assembly on said nose that extends beyond said surrounding sleeve before said nose is crushed, said lower end assembly absorbing shock apart from crushing of said nose.

4. The system of claim 3, wherein:

said lower end assembly further comprises a biasing member that is compressed.

5. The system of claim 4, wherein:

said biasing member is at least in part embedded in a resilient cover.

6. The system of claim 5, wherein:

said biasing member comprises a coiled spring or a stack of Belleville washers or another flexible structure.

7. A shock absorber system for a tubular string supporting a tool in subterranean use, comprising;

a nose on a lower end of the string, said nose comprising at least one void to promote crushing said nose in a longitudinal direction on impact with a fixed object downhole;

a surrounding sleeve around said nose to resist radial dimensional growth of said nose during said crushing in a longitudinal direction;

said surrounding sleeve is movable with respect to said string during said crushing of said nose.

8. The system of claim 7, wherein:

said surrounding sleeve is releasably connected to an inner sleeve supported by the string with at least one breakable member.

9. The system of claim 8, wherein:

said nose is supported from said inner sleeve with at least one pin extending through aligned bores in said nose and said inner sleeve.

10. The system of claim 7, wherein:

said surrounding sleeve further comprises a resilient ring at a lower end thereof.

11. The system of claim 10, wherein:

said nose has a lower end that before crushing of said nose extends longer, shorter or evenly with said resilient ring.

12. The system of claim 7, further comprising:

a lower end assembly on said nose that extends substantially within said surrounding sleeve before said nose is crushed, said lower end assembly absorbing shock apart from crushing of said nose.

13. The system of claim 12, wherein:

said lower end assembly further comprises a biasing member that is compressed.

14. The system of claim 13, wherein:

said biasing member is at least in part embedded in a resilient cover.

15. The system of claim 14, wherein:

said biasing member comprises a coiled spring or a stack of Belleville washers or another flexible structure.

16. The system of claim 7, further comprising:

a shock absorbing device comprising a housing and a piston defining a variable volume cavity when relative movement between them occurs, said relative movement displacing fluid from said cavity.

17. The system of claim 16, wherein:

said relative movement displaces fluid from said cavity through an orifice spaced from said piston.

18. The system of claim 17, wherein:

said cavity further comprises a breakable member to hold fluid in said cavity until said relative movement occurs.

19. The system of claim 18, wherein:

said housing and said piston are releasably held together until an impact occurs on said nose.

20. The system of claim 19, wherein:

said housing and said piston are initially held together by at least one shear pin.

21. The system of claim 18, wherein:

said breakable member breaks from increasing hydrostatic pressure as said breakable member moves lower in a wellbore.

22. The system of claim 18, wherein:

said breakable member breaks from said relative movement between said piston and said housing.

23. The system of claim 22, wherein:

said relative movement builds pressure in said cavity to break said breakable member.

24. The system of claim 23, wherein:

said breakable member comprises a rupture disc.

25. The system of claim 16, wherein:

the pressure rating for said housing is lower than the pressure rating of a string that supports said housing in a wellbore.

26. The system of claim 16, wherein:

said piston comprises an upper end disposed substantially in said housing that is larger than a lower end thereof that extends beyond said housing.

27. The system of claim 26, wherein:

said housing comprises an internal shoulder that captures said upper end of said piston to allow removal of said housing to bring said piston with said housing.

28. The system of claim 27, wherein:

said relative movement creates a variable volume space between said piston and said housing and said piston comprises a passage from said cavity that leads to said space to prevent pressure reduction in said space.

29. The system of claim 16, wherein:

said nose is releasably mounted to said shock absorbing device.

30. The system of claim 16, wherein:

said void comprises a passage transverse to a longitudinal axis;

said nose further comprises a longitudinally oriented blind bore that intersects said at least one transverse passage;

said nose collapsing longitudinally and radially into said bore and said passages on impact downhole.

31. The system of claim 7, wherein:

said void comprises a passage transverse to a longitudinal axis;

said nose further comprises a longitudinally oriented blind bore that intersects said at least one transverse passage;

said nose collapsing longitudinally and radially into said bore and said passages on impact downhole.

32. The system of claim 31 wherein:

said nose is releasably mounted to said shock absorbing device.

33. The system of claim 32 wherein:

said nose is made from a soft metal, plastic, elastomers or an encased gel.

34. The system of claim 31 wherein:

said passage contains a fluid that is propelled out of said nose on impact to further diffuse the kinetic energy of impact on said nose.

* * * * *

UNITED STATES PATENT AND TRADEMARK OFFICE

CERTIFICATE OF CORRECTION

PATENT NO. : 8,820,402 B2
APPLICATION NO. : 13/346446
DATED : September 2, 2014
INVENTOR(S) : Troy L. Smith, II et al.

It is certified that error appears in the above-identified patent and that said Letters Patent is hereby corrected as shown below:

On the title page item (75) Inventors: Please delete "Douglas A. G. Lowery" and insert therefor -- Douglas A. G. Lowry --.

Signed and Sealed this
Thirteenth Day of January, 2015

Michelle K. Lee

Michelle K. Lee
*Deputy Director of the United States Patent and Trademark Office*